US010348045B2

(12) United States Patent
Lybrand

(10) Patent No.: US 10,348,045 B2
(45) **Date of Patent: *Jul. 9, 2019**

(54) HERMAPHRODITIC PIN AND SOCKET CONNECTOR

(71) Applicant: AVX Corporation, Fountain Inn, SC (US)

(72) Inventor: Brent Lybrand, Moore, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/862,783

(22) Filed: Jan. 5, 2018

(65) Prior Publication Data

US 2018/0166838 A1 Jun. 14, 2018

Related U.S. Application Data

(63) Continuation of application No. 15/375,269, filed on Dec. 12, 2016, now Pat. No. 9,876,323.

(51) Int. Cl.

| | |
|---|---|
| ***H01R 24/84*** | (2011.01) |
| ***H01R 13/28*** | (2006.01) |
| *H01R 103/00* | (2006.01) |

(52) U.S. Cl.

CPC ..... *H01R 24/84* (2013.01); *H01R 13/28* (2013.01); *H01R 2103/00* (2013.01)

(58) Field of Classification Search

CPC ..... H01R 24/84; H01R 13/28; H01R 2103/00
USPC ..... 439/291, 290, 289, 850, 851, 852, 854
See application file for complete search history.

(56) References Cited

U.S. PATENT DOCUMENTS

| | | | | |
|---|---|---|---|---|
| 3,467,942 | A * | 9/1969 | Stoyer | H01R 24/84 439/293 |
| 5,035,639 | A | 7/1991 | Kilpatrick et al. | |
| 6,332,799 | B1 * | 12/2001 | Torii | H01R 13/641 439/352 |
| 6,478,593 | B2 * | 11/2002 | Miwa | H01R 13/6485 439/181 |
| 8,454,378 | B2 * | 6/2013 | Osterhart | H01R 13/4223 439/284 |
| 8,579,650 | B2 * | 11/2013 | Keswani | H01R 4/4818 439/441 |
| 9,118,157 | B2 | 8/2015 | Miyaki | |
| 2001/0019911 | A1 * | 9/2001 | Miwa | H01R 13/6485 439/181 |

(Continued)

OTHER PUBLICATIONS

IBM Technical Disclosure Bulletin, Oct. 1, 1973, vol. 16, Issue 5.

(Continued)

*Primary Examiner* — Harshad C Patel
(74) *Attorney, Agent, or Firm* — Foley & Lardner LLP

(57) ABSTRACT

An electrical connector for use with wires is disclosed that includes an electrical contact and an insulated housing. The electrical contact includes a wire contact portion and a connector contact portion. The wire contact portion connects the electrical connector to a wire. The connector contact portion includes a male contact prong and a female contact socket. The electrical contact may be positioned within an insulated housing that is designed to connect both the male contact prong and the female contact socket when mated with another electrical device.

20 Claims, 6 Drawing Sheets

(56) References Cited

U.S. PATENT DOCUMENTS

| | | | | |
|---|---|---|---|---|
| 2002/0031944 | A1* | 3/2002 | Endo | H01R 13/641 439/595 |
| 2006/0178029 | A1* | 8/2006 | Fabian | H01R 24/84 439/284 |
| 2007/0059973 | A1* | 3/2007 | Fabian | H01R 13/112 439/475 |
| 2013/0210279 | A1 | 8/2013 | Mori et al. | |
| 2014/0295681 | A1 | 10/2014 | Miyaki | |
| 2016/0240970 | A1 | 8/2016 | Wu et al. | |

OTHER PUBLICATIONS

International Search Report and Written Opinion in International Application No. PCT/US2017/065611 dated Mar. 29, 2018 (11 pages).
Non-Final Rejection Office Action in U.S. Appl. No. 15/375,269 dated Jun. 16, 2017 (11 pages).
Notice of Allowance in U.S. Appl. No. 15/375,269 dated Sep. 28, 2017 (5 pages).

* cited by examiner

HERMAPHRODITIC PIN AND SOCKET CONNECTOR

CROSS-REFERENCE TO RELATED APPLICATIONS

This application is a continuation of U.S. patent application Ser. No. 15/375,269 (now U.S. Pat. No. 9,876,323), filed Dec. 12, 2016, the contents of which are incorporated herein by reference in its entirety.

FIELD

The present application relates generally to the field of electrical connectors, and more particularly to a type of connector used to connect an insulated wire to a component.

BACKGROUND

The following description is provided to assist the understanding of the reader. None of the information provided or references cited is admitted to be prior art.

Various types of connectors are used for forming connections between an insulated wire and any manner of electronic or electrical component. These connectors are typically available as sockets, plugs, and shrouded headers in a vast range of sizes, pitches, and plating options. Typically, a connector is electrically coupled to an electrical component that is designed to receive the connector. In other words, two different types of connectors are commonly needed in order to achieve mechanical and electrical coupling (e.g., a socket connector typically needs a plug to achieve full coupling).

SUMMARY

In accordance with an illustrative embodiment, an electrical connector is provided that includes an electrical contact and an insulated housing. The electrical contact has an insert end, a wire contact portion, and a connector contact portion. The insert end includes a cage-like structure that has one or more conductive walls that define an inlet opening and a plurality of contact surfaces. The inlet opening of the electrical contact may be of any size or shape that will allow the electrical contact to receive a wire. Once a wire is received through the inlet opening, a contact tine that extends off one of the walls in the cage-like structure may be used to mechanically and electrically couple the wire within the wire contact portion. The connector contact portion extends from the wire contact portion and forms a male contact prong and a female contact socket. In some embodiments, the electrical connector may be housed within the insulated housing.

The male contact prong may be L-shaped and extend perpendicularly from the base of the connector contact portion while also extending in a forward direction along a centerline axis. Furthermore, the female contact socket is formed by two contact tines that extend away, in a forward direction, from the base of the connector contact portion. In an embodiment, a distal end of the male contact prong is located on a plane that is a distance above the plane of the two contact tines of the female contact socket. Additionally, the male contact prong is centered on the centerline axis of the electrical contact. Similarly, the female contact socket is centered along the centerline axis such that the two contact tines are symmetric to one another other.

In various embodiments, the two contact tines of the female contact socket may be of many different shapes or configurations. For example, the two contact tines of the female contact socket may have knobs that extend inwardly toward a centerline axis of the electrical connector, or the two contact tines of the female contact socket may be angled inwardly toward the centerline axis as they extend forwardly from the base of the connector contact portion. The distance between the two contact tines of the female contact socket may be less than the thickness of the male contact prong. This allows for the two female contact tines to compress a corresponding male contact prong and create an electrical and mechanical connection. In some embodiments, the male contact prong may extend less than the entire distance to the end of the female contact socket.

In an embodiment, the cage-like structure of the insert end, the contact tine, and the plurality of contact surfaces create a pinch-point to receive and secure the wire. For example, the contact tine may extend from a first surface of the plurality of contact surfaces towards the base portion of the wire contact portion that is a second surface. The contact tine of the wire contact portion may be angled towards the second surface and direct the wire towards the second surface. The sidewalls of the cage-like structure may also include projections that extend in a forward direction. In some embodiments, the projections of the sidewall can be utilized to help mechanically and/or electrically couple the wire to the electrical contact.

The electrical contact may be of many different shapes. In an embodiment, the base of the wire contact portion is rectangular in shape with at least one jut that extends outward from the centerline of the electrical contact. The at least one jut is triangular-shaped and allows the electrical contact to be seated and secured within a molded recesses of a housing.

In a system, at least two electrical connectors are mechanically and/or electrically coupled via the coupling of two electrical contacts that each have both a male contact prong and a female contact socket. In an embodiment, at least one of the electrical contacts is electrically connected to one or more wires. The two electrical contacts may be coupled by mating the male contact prongs to the female contact sockets of the first and second electrical contacts. Further, the electrical contacts may be housed within respective insulated housings. The insulated housings may include a ridge that houses the female contact socket of the electrical contact and an inlet that houses the male contact prong of the electrical contact. The insulated housings may be coupled together such that the electrical contacts within the insulated housings are properly electrically and mechanically coupled. In some embodiments, the insulated housings also have a male-latch prong and a latching device that ensures that two of the insulated housings are secured together after they are coupled.

In an embodiment, the electrical contact is formed from a single stamped metal sheet bent or otherwise formed into the structure. Any number and configuration of cuts, reliefs, and the like, may be formed in the metal sheet to facilitate bending or otherwise shaping the metal sheet into the electrical contact having the features described herein.

The electrical connector is not limited by its wire contact portion or other components. Particular embodiments of insulation displacement connectors are described in greater detail below by reference to the examples illustrated in the various drawings.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a hermaphroditic pin and socket connector that includes both a male end and a female socket. This feature allows for two separate mechanical and electrical connections to be made when a first connector is mated with a second connector. Such hermaphroditic connectors are more resistive to rotational movement, create better mechanical connections, and are more resistant to damage since they cannot be as easily moved or rotated in relation to the second connector. Another advantage of such hermaphroditic connectors involves the connection of two wires together. The hermaphroditic connector eliminates the need to switch the end of a wire from a female to male end to form a connection with a second wire at the female end because the hermaphroditic connector is immediately compatible with a second hermaphroditic connector. Furthermore, the unique design ensures that the connector cannot be easily connected to an unsuitable electronic device. Such a hermaphroditic connector is thus beneficial for use with sensitive electronic equipment that may be easily damaged if improperly connected to a non-compatible device.

Various embodiments of a hermaphroditic electrical connector are illustrated throughout FIGS. 1 through 6. The electrical connector is configured for connecting a conductive core of an insulated wire to another electrical component. In an embodiment, such an electrical component may be another electrical connector, an electrical component that itself is connected to another electrical connector, or an electrical component having a connection end that is compatible with the electrical connector. For ease of explanation and illustration, the electrical connector is illustrated and referred to herein in the context of facilitating electrical connection of a wire to a second electrical connector. It should be appreciated that the electrical connector is not limited by a number of wire positions, and more than one wire may connect to the electrical contact.

Figure 1A:
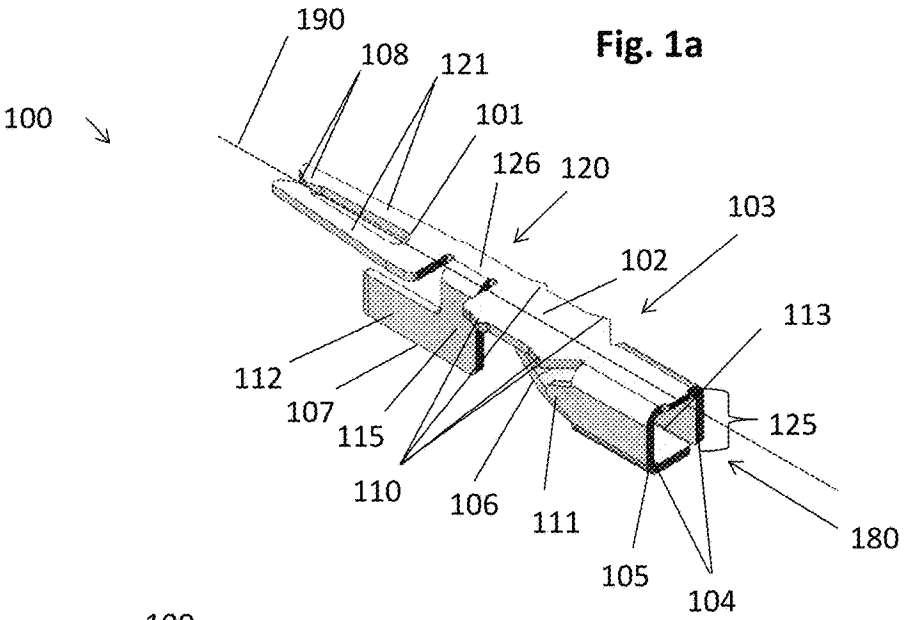
FIG. 1*a* depicts an isometric view of an electrical contact in accordance with an illustrative embodiment.
Figure 1B:
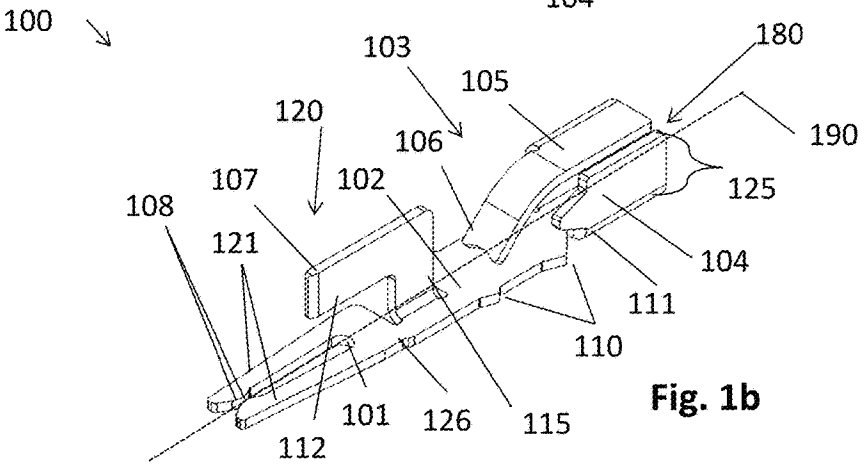
FIG. 1*b* depicts a second isometric view of an electrical contact in accordance with an illustrative embodiment.

Referring to FIGS. 1*a* and 1*b* in general, an electrical contact 100 is depicted as a single element electrical contact in accordance with various illustrative embodiments. FIG. 1*a* depicts an isometric view of the electrical contact 100 in accordance with an illustrative embodiment. FIG. 1*b* depicts a second isometric view of the electrical contact 100 in accordance with an illustrative embodiment. The electrical contact 100 is particularly suited for connecting a wire to an electrical component, such as another electrical contact 100. An insert end 180 of the electrical contact 100 includes a cage-like structure 125 that defines an inlet opening 113 that is configured to receive an electrical wire. The wire may be a stranded or solid core wire having a conductive core surrounded by an insulation material. Prior to insertion of the wire into the inlet opening 113 the insulation material of the wire may be stripped away exposing the conductive core of the wire. A contact tine 106 extends from a first surface 105 of a wire contact portion 103 towards a base 102 (i.e., a second surface) of the wire contact portion 103. The cage-like structure 125 is defined by side walls 104, the first surface 105, and the base 102. The contact tine 106 is an electrically-conductive element that extends from the first surface 105 and toward the base 102 at an angle. The contact tine 106 and the base 102 of the wire contact portion 103 create a pinch-point such that the conductive element of the wire can be secured between the contact tine 106 and the base 102 and an electrical connection created there between.

The inlet opening 113 is defined by four walls that make up the cage-like structure 125. In alternative embodiments, the inlet opening 113 may be defined by two, three, four, five, or more walls. Furthermore, the inlet opening 113 may be constructed to have different size openings and may have multiple configurations, such as a circular configuration, a semicircular configuration, and so forth. The size of inlet opening 113 may change depending on a gauge of wire that will be received by the inlet opening 113. The side walls 104 of the inlet opening 113 may have a projection 111 that extends in a forward direction toward a base 126 of the connector contact portion 120. In some embodiments, the projection 111 may be utilized to secure the wire or add stability. The projection 111 may also serve as a contact tine wherein the projection 111 of the side walls 104 extends inwardly towards a centerline axis 190 of the electrical contact 100 to create a pinch point and a point of contact with the inserted wire.

In some embodiments, the base 102 of the wire contact portion 103 is generally rectangular in shape. However, it will be appreciated that other shapes are possible and within the scope of this disclosure, such as ovals, squares, and other polygons. The base 102 may also include one or more juts 110 that extend outward from the centerline axis 190. FIG. 1 depicts four juts 110 that are triangle-shaped and may be used to add grip to the electrical contact 100, and/or allow for the electrical contact 100 to be secured within a housing by seating the juts within recesses in the housing. In alternative embodiments, the juts 110 may have different shapes. The unique shape of the base 102 with the juts 110 allows for the electrical contact 100 to be securely seated within a recess of a housing. The shape provides extra friction between the electrical contact 100 and the housing that restricts movement of the electrical contact.

As indicated above, the electrical contact 100 further includes the connector contact portion 120. The connector contact portion 120 includes a base 126 that is connected to the base 102 of the wire contact portion 103. The connector contact portion 120 further includes a male contact prong 107 and a female contact socket 101 that are each connected to the base 126. The male contact prong 107 has an L-shape in which a first portion 115 of the male contact prong extends in a perpendicular direction from the base 126 and a second portion 112 of the male contact prong extends in a forward direction parallel to the centerline axis 190. The first portion 115 of the male contact prong 107 is connected to the base 126 of the connector contact portion 120 at the centerline axis 190 of the electrical contact 100 and the second portion 112 of the male contact prong 107 is centered on the centerline axis 190. In alternative embodiments, the male contact prong 107 may have different shapes and may be connected to the base 126 of the connector contact portion 120 by different means. For example, the male contact prong 107 may be tapered on one end or be J-shaped. A taper on a distal end of the second portion 112 of the male contact prong allows for the male contact prong 107 to be more easily inserted into a corresponding female socket. The male contact prong 107 is conductively connected to the base 126 of the connector contact portion 120 by virtue of the contact 100 being one continuous conductive piece. Alternatively, the male contact prong 107 may include two or more conductive pieces that are welded, soldered, or otherwise coupled together.

The female contact socket 101 includes two separate contact tines 121 having a space there between. The two contact tines 121 extend in a forward direction from the base 126 of the connector contact portion 120. The two contact tines 121 extend forward in a same plane as the base 126 of the connector contact portion 120. In alternative embodiments, the two contact tines 121 may extend off-plane from the base 126. The female contact socket 101 is centered on the centerline axis 190 such that the two contact tines 121 are symmetrical about the centerline axis. The two contact tines 121 may be angled inward towards the centerline axis 190 such that the distance between the two contact tines 121 decreases as they extend forward from the base 126. Additionally, the two contact tines 121 may have knobs 108 that extend towards the centerline axis 190 at the end of each contact tine 121. The knobs 108 may be half-circular, rectangular, triangular, or any other polygonal shape. The distance between the knobs 108 is preferably less than a thickness of the male contact prong 107. This will ensure that the two contact tines 121 compress a corresponding male contact prong 107 and a mechanical and electrical connection is created between the female contact socket 101 and the corresponding male contact prong 107. As depicted, the female contact socket 101 and the male contact prong 107 are centered on the centerline axis 190 which allows for two corresponding electrical contacts 100 to be easily positioned within a housing and coupled together. In alternative embodiments, the female contact socket 101 and the male contact prong 107 may be configured in any arrangement that allows for two connectors to be coupled.

In alternative embodiments, the female contact socket 101 may include more or less than two tines. For example, the female contact socket 101 may be a singular socket-shaped tine, or it may include three, four, or more contact tines. Preferably, the female contact socket 101 is adapted such that it can receive and secure a male contact prong 107 to create an electrical connection. The two contact tines 121 may be different shapes. For example, the two contact tines 121 may be tapered such that the width of the tines is larger at the base 126 of the connector contact portion 120 and decreases as the contact tines 121 extend in a forward direction. In an embodiment, the length that the male contact prong 107 extends in a forward direction is less than the length of the two contact tines 121 of the female socket 101.

The electrical contact 100 is formed of a single electrically-conductive element. The single electrically-conductive element may be any suitable electrically-conductive metal material having a gauge and other physical characteristics suitable for maintaining the shape of the electrical contact 100 in the mounting process, as well as in the operating environment of the electrical component to which the electrical contact 100 is mounted. However, it will be appreciated that the electrical contact 100 may also be formed of multiple conductive elements that are welded, soldered, or otherwise electrically and mechanically connected.

Figure 2:
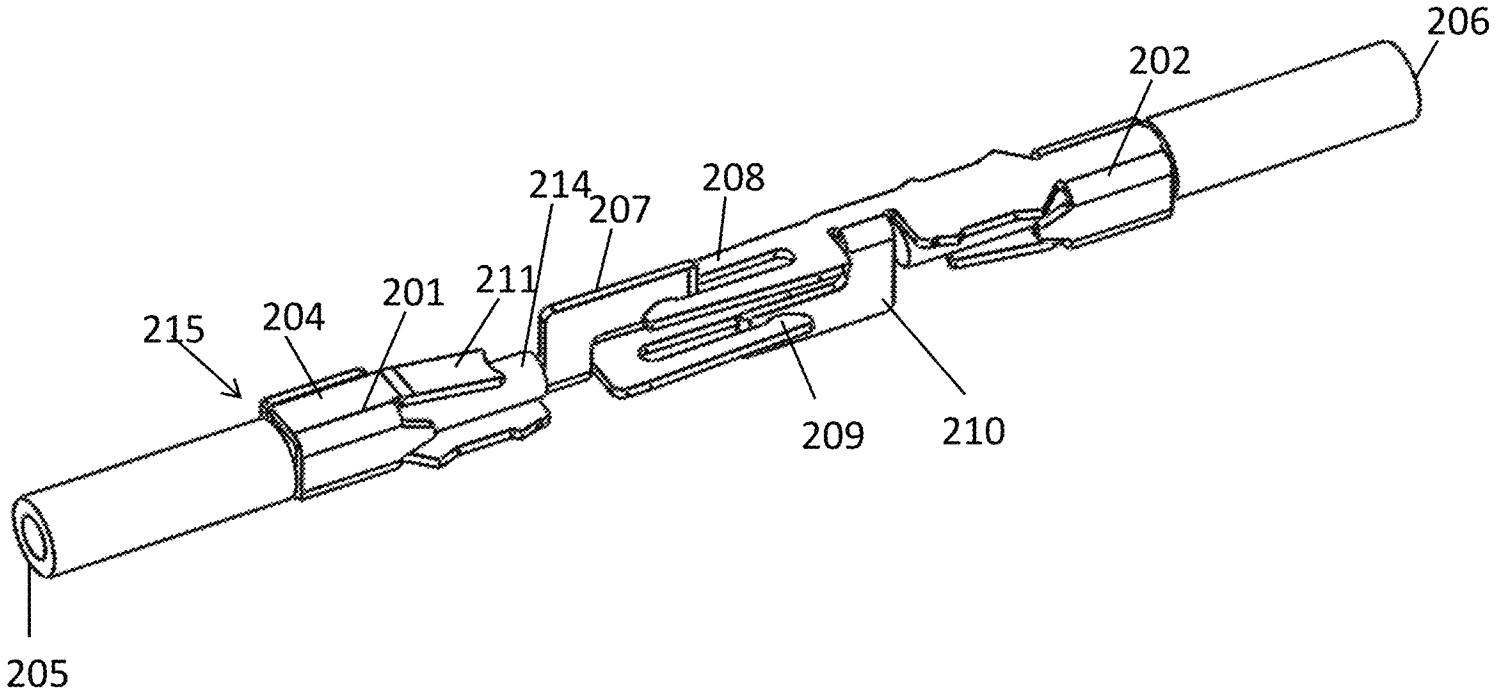
FIG. 2 depicts an isometric view of mated electrical contacts without housings in accordance with an illustrative embodiment.

FIG. 2 depicts an isometric view of mated electrical contacts without housings in accordance with an illustrative embodiment. Generally, FIG. 2 depicts a first wire 205 that is connected to a second wire 206 via the electrical connection of two mated electrical contacts 201 and 202. The first wire 205 is a solid core wire having a core 214 that was stripped of its insulation prior to insertion. The core 214 of the first wire 205 is inserted into the first electrical contact 201 and an electrical connection is made. A contact tine 211 of the first electrical contact 201 ensures that the first wire 205 is physically secured within the insert end 215 of the first electrical contact 201 and an electrical connection formed between the electrical contact 201 and the first wire 205.

A male contact prong 207 of the first electrical contact 201 is mated with a female contact socket 208 of the second electrical contact 202, thus creating a first mechanical and electrical connection between the first electrical contact 201 and the second electrical contact 202. A female contact socket 209 of the first electrical contact 201 is mated with a male contact prong 210 of the second electrical contact 202, thus creating a second mechanical and electrical connection between first electrical contact 201 and the second electrical contact 202. Additionally, the second electrical contact 202 is mechanically and electrically connected to the second wire 206 in a similar manner to which the first wire 205 is secured within the first electrical contact 201.

In alternative embodiments, the first wire 205 and the second wire 206 may be a stranded or solid core wire surrounded by a variety of suitable insulation material. The core 214 of the wire 205 may be made from a variety of suitable conductive materials, such as copper, tin, aluminum, or a combination thereof. In alternative embodiments, the core 214 may be secured within the electrical contacts via the contact tine 211, solder, additional contact tines, or a combination thereof.

Figure 3A:
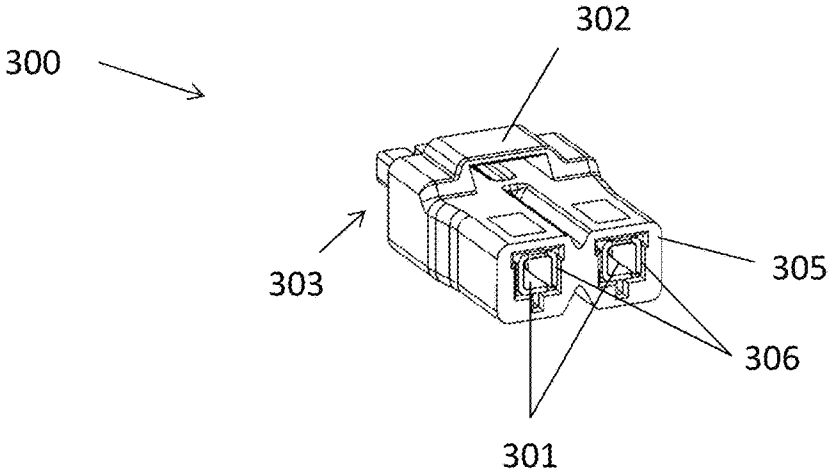
FIG. 3*a* depicts an isometric view of an electrical connector including an electrical contact housed within an insulated housing in accordance with an illustrative embodiment.

FIG. 3*a* depicts an isometric view of an electrical connector 300 including two electrical contacts 306 housed within an insulated housing 305 in accordance with an illustrative embodiment. Respective inlet openings 301 of each of the electrical contacts 306 may receive a respective wire and the insulated housing 305 helps ensure that no electrically conductive material is exposed to a user. The insulated housing 305 thereby creates an extra level of safety when a user is connecting one electrical connector to another. The shape of a receiving end 303 of the insulated housing 305 ensures that the electrical connector is 300 properly aligned with another electrical connector when connected together. This also ensures that the optimal connection is made between the electrical contacts 306 and corresponding contacts to which they are connected. The insulated housing 305 also includes a female latching device 302 that allows for a first insulated housing and a second insulated housing to be mated and latched together. The female latching device 302 includes a receptacle on top of the insulated housing 305 that may receive a male-latch prong 304 from a second insulated housing device. In alternative embodiments, the latching device may be of different sizes, types, or configurations. For example, the latching device may be a dimple that a lever of a second insulated housing is configured to mate with.

Figure 3B:
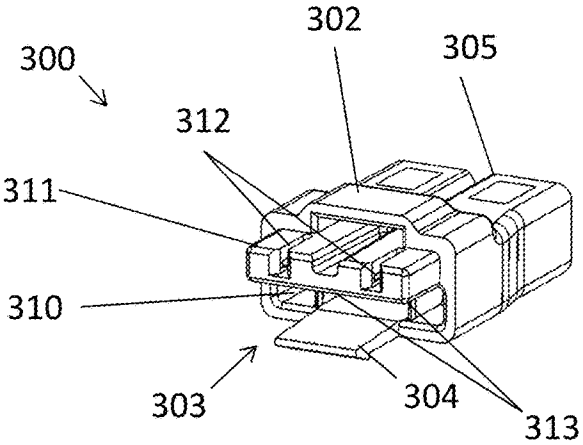
FIG. 3*b* depicts a second isometric view of an electrical connector in accordance with an illustrative embodiment.

FIG. 3*b* depicts a second isometric view of the electrical connector 300 in accordance with an illustrative embodiment. The receiving end 303 of the insulated housing 305 includes a ridge 311 and an inlet 310. The ridge 311 has a cut-out 312 that exposes a center (e.g., a space between contact tines) of a female contact socket of an electrical contact (e.g., 306). The inlet 310 exposes a male contact prong 313 of the electrical contact. Therefore, when the insulated housings of respective electrical connectors are connected, the ridge 311 of the first insulated housing enters the inlet 310 of the second insulated housing, and the ridge 311 of the second insulated housing enters the inlet 310 of the first insulated housing. More specifically, when the insulated housings are connected, the male contact prong 313 enters the cut-out 312 and the male contact prong 313 is compressed by the contact tines of the female contact socket thereby creating a mechanical and electrical connection. Furthermore, the male-latch prong 304 of the insulated housings would enter the female latching device 302 of the insulated housings to secure the first insulating housing to the second insulating housing. The result of this mating is that the electrical contacts are properly connected (i.e., the female contact sockets are mated and in electrical connection with the male contact prongs). In alternative embodiments, the ridge 311 and the inlet 310 may be of any configuration that allows for the mating of two insulated housings.

Figure 4A:
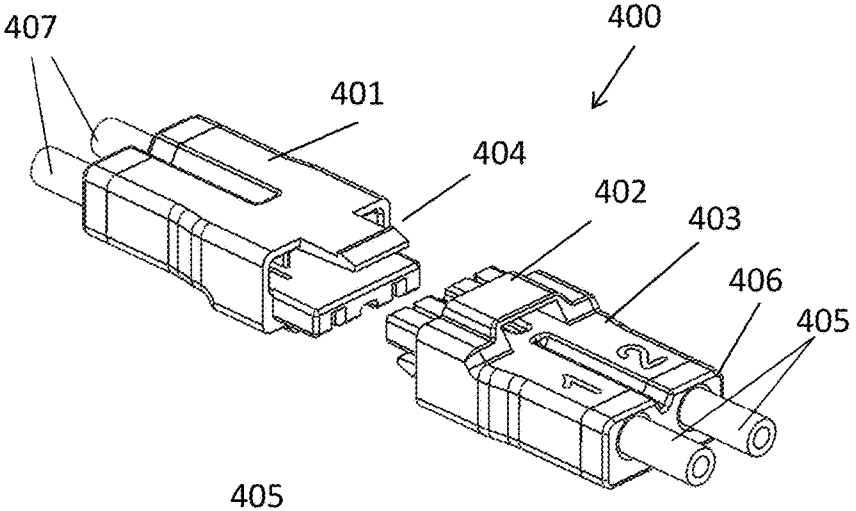
FIG. 4*a* depicts an isometric view of two uncoupled electrical connectors in accordance with an illustrative embodiment.

FIG. 4*a* depicts an isometric view of two uncoupled electrical connectors 400 in accordance with an illustrative embodiment. First wires 407 are electrically connected to first electrical contacts 450 within a first insulated housing 401. The first insulated housing 401 has a ridge 411, an inlet 410, and a male-latch prong 404. Similarly, a second insulated housing 403 has a ridge 410, an inlet (not depicted), and a latching device 402. Second wires 405 are electrically connected to second electrical contacts 406 housed within the second insulated housing 403. Therefore, when the two insulated housings are connected, the ridge 411, the inlet 410, and the male latch prong 404 of the first insulated housing 401 mate with the inlet, the ridge 410, and the latching device 402 of the second insulated housing 403, and an electrical connection is created between the first wires 407 and the second wires 405 via an electrical connection created between the first electrical contacts 450 and the second electrical contacts 406.

Figure 4B:
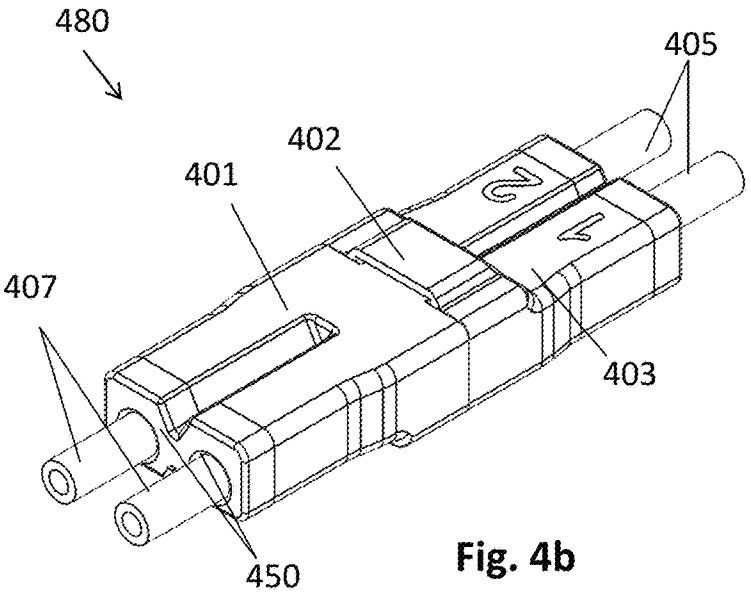
FIG. 4*b* depicts an isometric view of two coupled electrical connectors in accordance with an illustrative embodiment.

FIG. 4*b* depicts an isometric view of the two coupled electrical connectors 480 in accordance with an illustrative embodiment. The latching device 402 ensures that the electrical connectors are retained in a coupled position and cannot easily fall apart. As a result of the coupling, the first electrical contacts 450 positioned within the first housing 401 is mated with the second electrical contacts 406 positioned within the second housing 403, and an electrical connection is made between the first wires 407 and the second wires 405. FIGS. 4*a* and 4*b* depict two electrical contacts within each insulated housing. In alternative embodiments, an insulated housing may house a one, two, three, or more electrical contacts. Similarly, the insulated housing may make a connection between two, four, six, or more electrical contacts when mated with another insulated housing.

Figure 5:
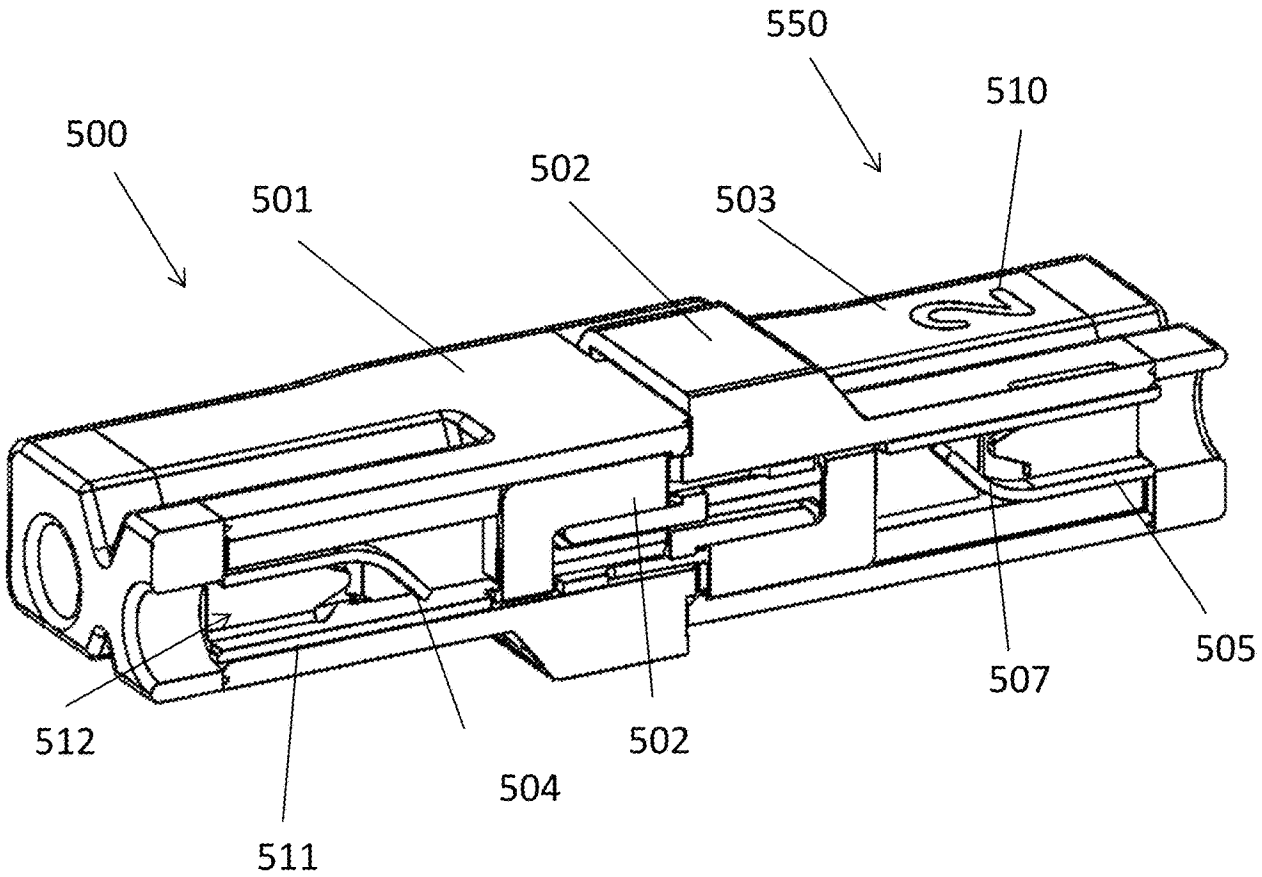
FIG. 5 depicts a vertical cross-sectional view of two coupled electrical connectors in accordance with an illustrative embodiment.

FIG. 5 depicts a vertical cross-sectional view of two coupled electrical connectors 500, 550 in accordance with an illustrative embodiment. A first insulated housing 501 is coupled with a second insulated housing 503, and they are secured together via the mating of latching devices 502 located on the top and bottom of the insulated housings. A first electrical contact 511 is secured within the first insulated housing 501, and a second electrical contact 505 is secured within the second insulated housing 503. The inlet opening 512 of the first electrical contact 511 is configured to receive a stripped wire and a contact tine 504 is configured to secure the core of the wire to ensure a mechanical and electrical connection was made. A male contact prong 502 of the first electrical contact 511 is mated with the female contact socket (not depicted) of the second electrical contact 505, and a female contact socket (not depicted) of the first electrical contact 511 is mated with a male contact prong 507 of the second electrical contact 505. In another embodiment, each electrical connector 500, 550 also includes a number 510 that is either molded or printed in order identify the individual circuits.

Figure 6:
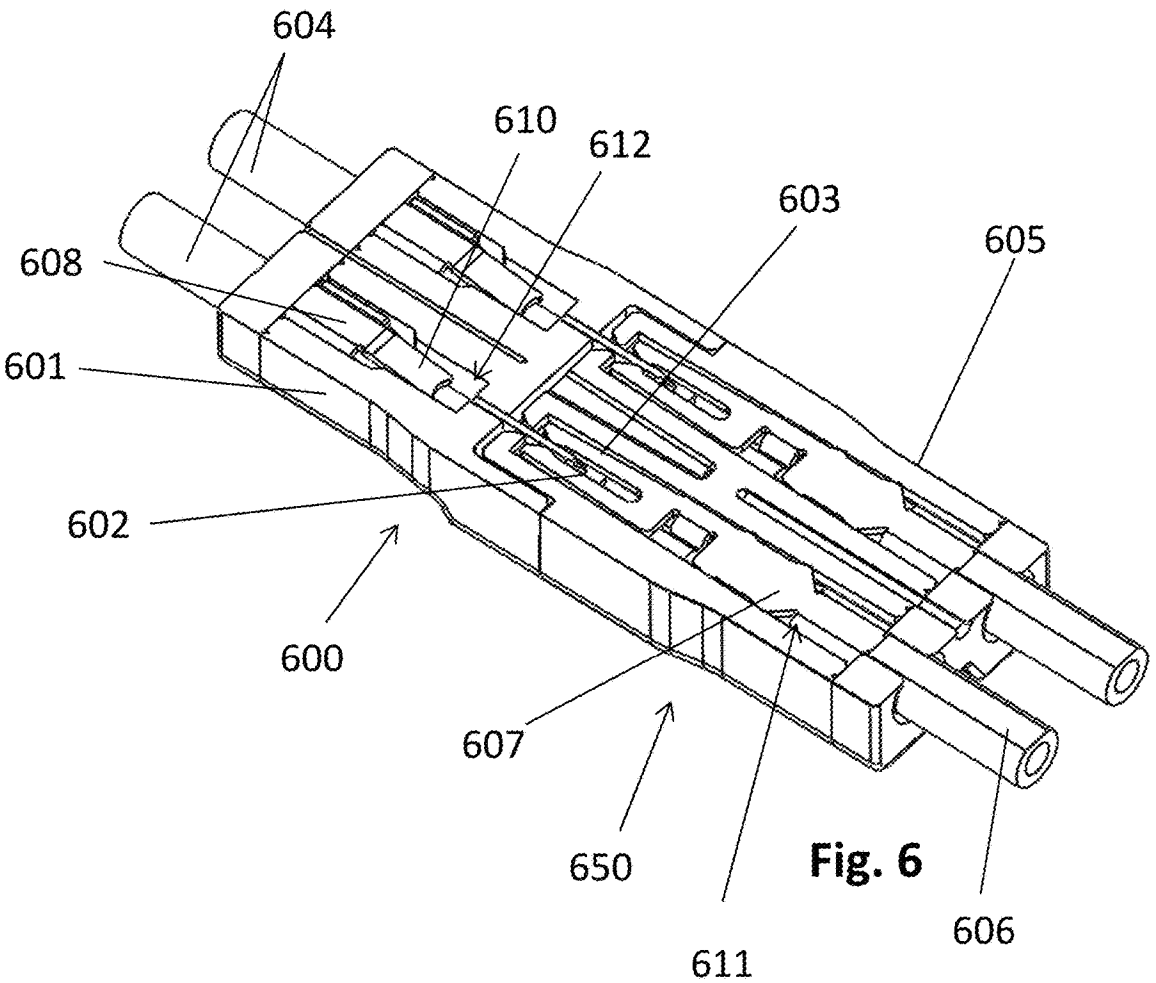
FIG. 6 depicts a horizontal cross-sectional view of two coupled electrical connectors in accordance with an illustrative embodiment.

FIG. 6 depicts a horizontal cross-sectional view of two coupled electrical connectors 600, 650 in accordance with an illustrative embodiment. A first electrical contact 608 is within a first insulated housing 601, and a second electrical contact 607 is within a second insulated housing 605. A first wire 604 is electrically connected to a first electrical contact 608 via a pinch-point created by the contact tine 610. The first electrical contact 608 is connected to a second electrical contact 607 via mating of male contact prongs 603 and female sockets 602. The second electrical contact 607 may also be connected to a wire 606. In an embodiment, the electrical contacts 607 and 608 are securely placed within the insulated housings 601 and 605 with little room for the electrical contacts 607 and 608 to shift or move. The insulated housings 601 and 605 may be molded to the shape of the electrical contacts 607 and 608 in order to ensure that they are secured within the housing. In other words, each electrical contact 607 and 608 is securely seated in respective molded recesses 611 and 612 within respective insulated housings 601 and 605. The material of the insulated housings 601 and 605 may be of any electrically-insulated material. For example, the insulated housing may be constructed from a polymer, fiber glass, rubber, glass, wood, or a combination thereof.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An electrical connector comprising:

a wire receiving portion configured to receive a wire; and a connector contact portion configured to form a connection with another electrical connector;

wherein the connector contact portion is conductively coupled to the wire receiving portion, and wherein the connector contact portion comprises a male contact prong and a female contact socket;

wherein the male contact prong comprises a first portion extending in a first direction away from a base of the connector contact portion and a second portion extending in a second direction forward along a centerline axis of the electrical connector, wherein the first direction is perpendicular to the second direction.

2. The electrical connector of claim 1, wherein the wire receiving portion comprises an insert end coupled to a wire contact portion, wherein the wire contact portion comprises a contact tine coupled to at least one of the one or more walls at the insert end, and wherein the contact tine is configured to form an electrical connection with the wire.

3. The electrical connector of claim 2, wherein the insert end comprises a cage-like structure having a plurality of contact surfaces, wherein the contact tine of the wire contact portion extends from a first surface of the plurality of contact surfaces, and wherein a base of the wire contact portion extends from a second surface of the plurality of contact surfaces that is opposite the first contact surface.

4. The electrical connector of claim 3, wherein the contact tine of the wire contact portion is angled from the first surface toward the second surface to direct the wire toward the base of the wire contact portion.

5. The electrical connector of claim 2, wherein the male contact prong extends perpendicularly from the base of the connector contact portion, and wherein the female contact socket comprises two contact tines extending from a forward portion of the base of the connector contact portion.

6. The electrical connector of claim 5, wherein the male contact prong is L-shaped.

7. The electrical connector of claim 5, wherein the first direction is perpendicular a center of the base of the connector contact portion.

8. The electrical connector of claim 5, wherein the male contact prong comprises a distal end located a distance above a plane in which the two contact tines of the female contact socket extend; and wherein the female contact socket and the male contact prong are centered on the centerline axis of the electrical connector.

9. The electrical connector of claim 5, wherein each of the two contact tines of the female contact socket comprises a protrusion extending toward the centerline axis of the electrical connector.

10. The electrical connector of claim 9, wherein a distance between the protrusion of a first of the two contact tines and the knob of a second of the two contact tines is less than a thickness of the male contact prong.

11. The electrical connector of claim 5, wherein the male contact prong extends less than an entire distance from a point at which the male contact prong is connected to the base of the connector contact portion to an end of the female contact socket.

12. The electrical connector of claim 3, wherein the base of the wire contact portion is rectangular in shape with a jut that extends outward from the centerline axis at each of the corners; and wherein the cage-like structure comprises at least two sidewalls that extend perpendicularly from the second contact surface, and wherein the at least two sidewalls comprises a projection extending in a forward direction toward the connector contact portion.

13. The electrical connector of claim 1, further comprising an insulated housing, wherein the electrical connector is housed within a molding inside the insulated housing.

14. The electrical connector of claim 1, wherein the electrical connector is a single piece of electrically-conductive material.

15. An electrical connector comprising:

a wire receiving portion configured to receive a wire; and a connector contact portion configured to form a connection with another electrical connector;

wherein the connector contact portion is conductively coupled to the wire receiving portion, wherein the connector contact portion comprises a male contact prong and a female contact socket, and wherein the female contact prong comprises two contact tines angled inwardly towards a centerline axis of the electrical connector as the two contact tines extend from a forward position of a base of the connector contact portion.

16. A system comprising:

a first electrical connector including a first electrical contact; and a second electrical connector configured to electrically and mechanically couple to the first electrical connector, wherein the second electrical connector includes a second electrical contact;

wherein each of the first electrical contact and the second electrical contact comprises a male contact prong and a female contact socket, wherein the female contact socket of the first electrical contact is configured to electrically and mechanically couple with the male contact prong of the second electrical contact, and wherein the male contact prong of the first electrical contact is configured to electrically and mechanically couple to the female socket of the second of electrical contact, wherein the male contact prong comprises a first portion extending in a first direction from a base of the connector contact portion and a second portion extending in a second direction along a centerline axis of the electrical connector, wherein the first direction is perpendicular to the second direction; and an electrical wire electrically connected to the first electrical contact.

17. The system of claim 16, wherein the first electrical connector further comprises a first insulated housing positioned around the first electrical contact, wherein the second electrical connector further comprises a second insulated housing positioned around the second electrical contact;

wherein the first insulated housing and the second insulated housing are configured to mate such that the first electrical contact and the second electric contact create an electrical connection; and wherein at least one wire extends out of one of the first insulated housing or the second insulated housing.

18. The system of claim 17, wherein the first insulated housing comprises a first ridge, a first inlet, a first male-latch prong, and a first latching device; and wherein the second insulated housing comprises a second ridge, a second inlet, a second male-latch prong, and a second latching device.

19. The system of claim 18, wherein the first ridge houses the female contact socket of the first electrical contact and the first inlet houses the male contact prong of the first electrical contact;

wherein the second ridge houses the female contact socket of the second electrical contact and the second inlet houses the male contact prong of the second electrical contact; and wherein the first insulated housing mates with the second insulated housing by coupling the first ridge with the second inlet, and by coupling the second ridge with the first inlet.

20. The system of claim 18, wherein the first insulated housing is securely coupled with the second insulated housing by mating the first male-latch prong with the second latching device and by mating the second male-latch prong with the first latching device.

* * * * *